US005374108A

United States Patent [19]

Saul et al.

[11] Patent Number: 5,374,108

[45] Date of Patent: Dec. 20, 1994

[54] SOFA BRIDGE

[75] Inventors: Jonathan R. Saul, LaSalle; Karl J. Komorowski, Petersburg; Larry P. LaPointe, Temperance, all of Mich.

[73] Assignee: La-Z-Boy Chair Company, Monroe, Mich.

[21] Appl. No.: 958,944

[22] Filed: Oct. 9, 1992

[51] Int. Cl.[5] ..... B60N 2/02

[52] U.S. Cl. ..... 297/378.1; 297/113; 297/411.33

[58] Field of Search ..... 297/113, 115, 194, 378.1, 297/411.33

[56] References Cited

U.S. PATENT DOCUMENTS

| | | | |
|---|---|---|---|
| 2,240,748 | 5/1941 | Bak . | |
| 2,714,419 | 8/1955 | Killington . | |
| 3,374,032 | 3/1968 | Del Giudice | 297/115 |
| 3,666,319 | 5/1972 | Moloney | 297/113 |
| 4,558,901 | 12/1985 | Yokoyama . | |
| 4,579,384 | 4/1986 | Sharod | 292/113 |
| 4,601,515 | 7/1986 | Hatsutta et al. . | |
| 5,064,244 | 11/1991 | Sproule . | |
| 5,104,182 | 4/1992 | Rasnick et al. . | |

FOREIGN PATENT DOCUMENTS

| | | | |
|---|---|---|---|
| 0630880 | 5/1936 | Germany | 297/113 |
| 284491 | 2/1928 | United Kingdom . | |
| 327905 | 7/1929 | United Kingdom . | |

*Primary Examiner*—P. Austin Bradley
*Assistant Examiner*—James Miner
*Attorney, Agent, or Firm*—Harness, Dickey & Pierce

[57] ABSTRACT

A modular "bridge" section is disclosed having a seat frame assembly and a detachable seat back assembly supported therefrom. The seat frame assembly and the detachable seat back assembly are upholstered to define an aesthetically-pleasing seat section which can be installed between two seat sections or, alternatively, which can be used as an armless end unit of a modular sectional arrangement. In addition, the detachable seat back assembly has a "flip-down" table and a storage bin incorporated therein wherein a linkage serves to support the flip-down table in both an upright position and an open position.

15 Claims, 4 Drawing Sheets

FIG 1
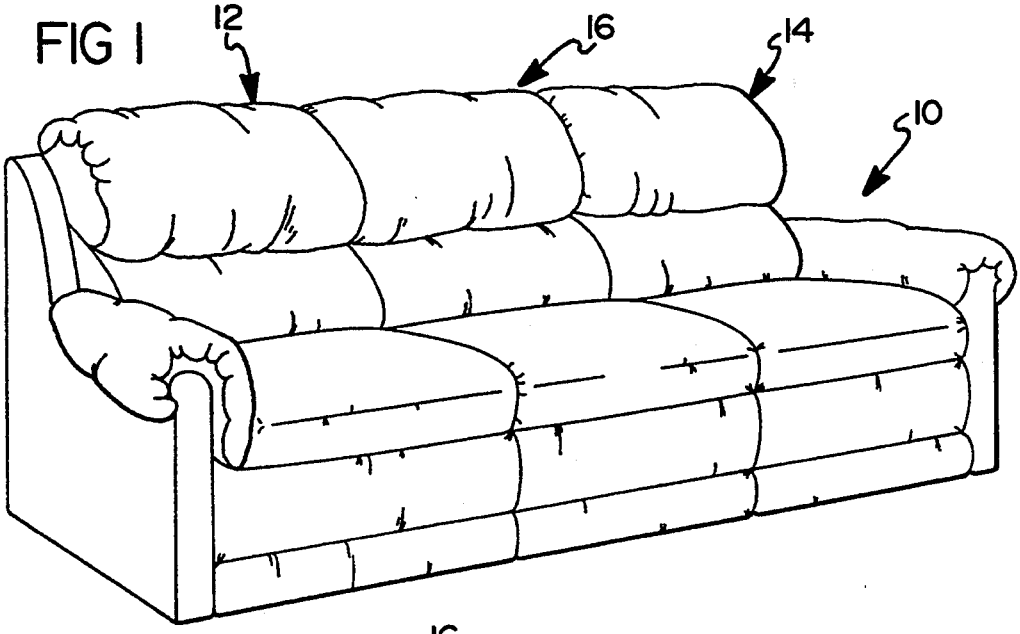
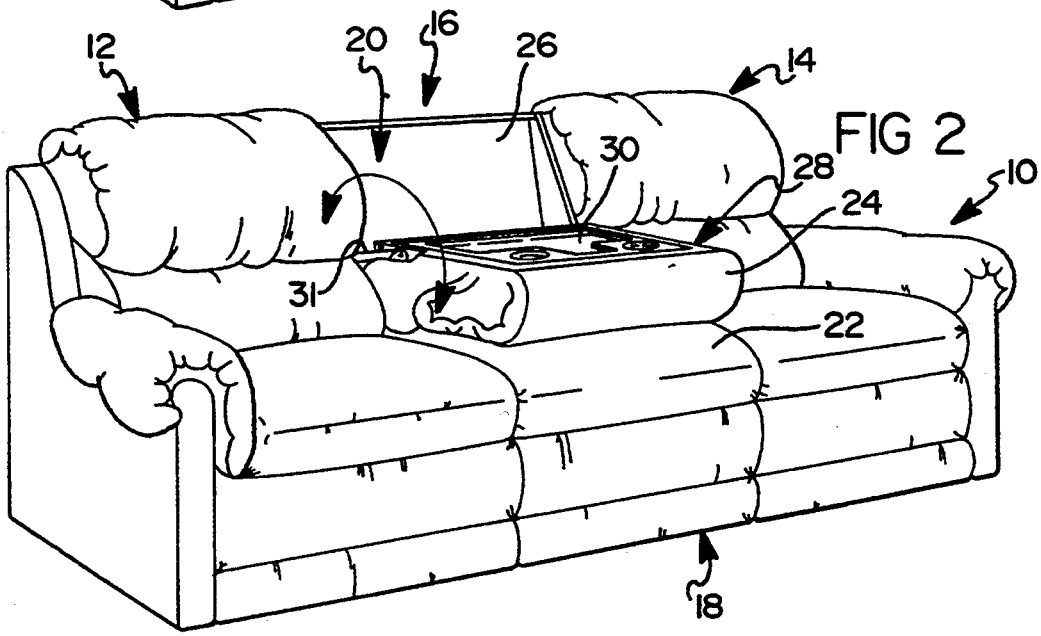
FIG 2
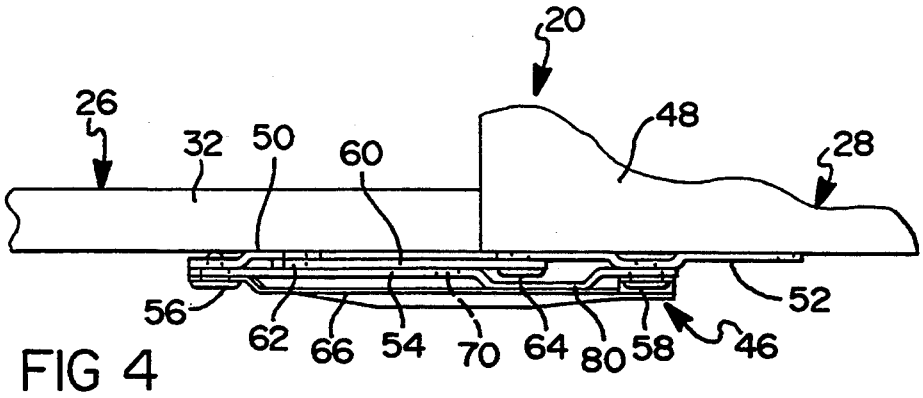
FIG 4

FIG 8
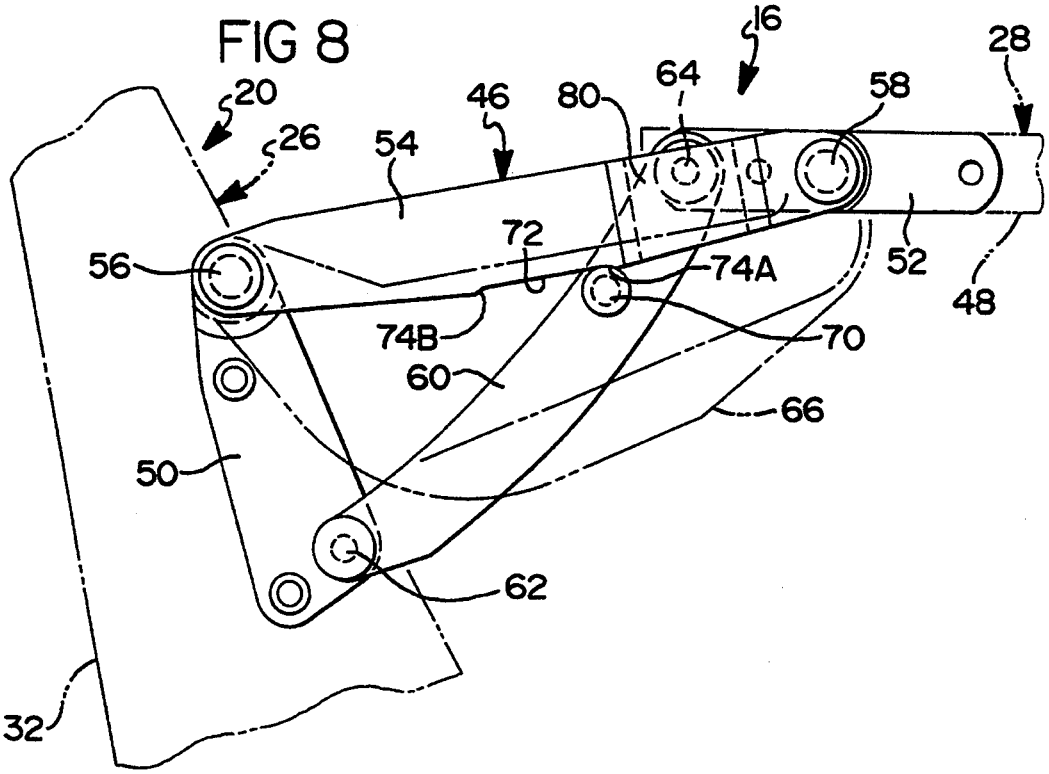
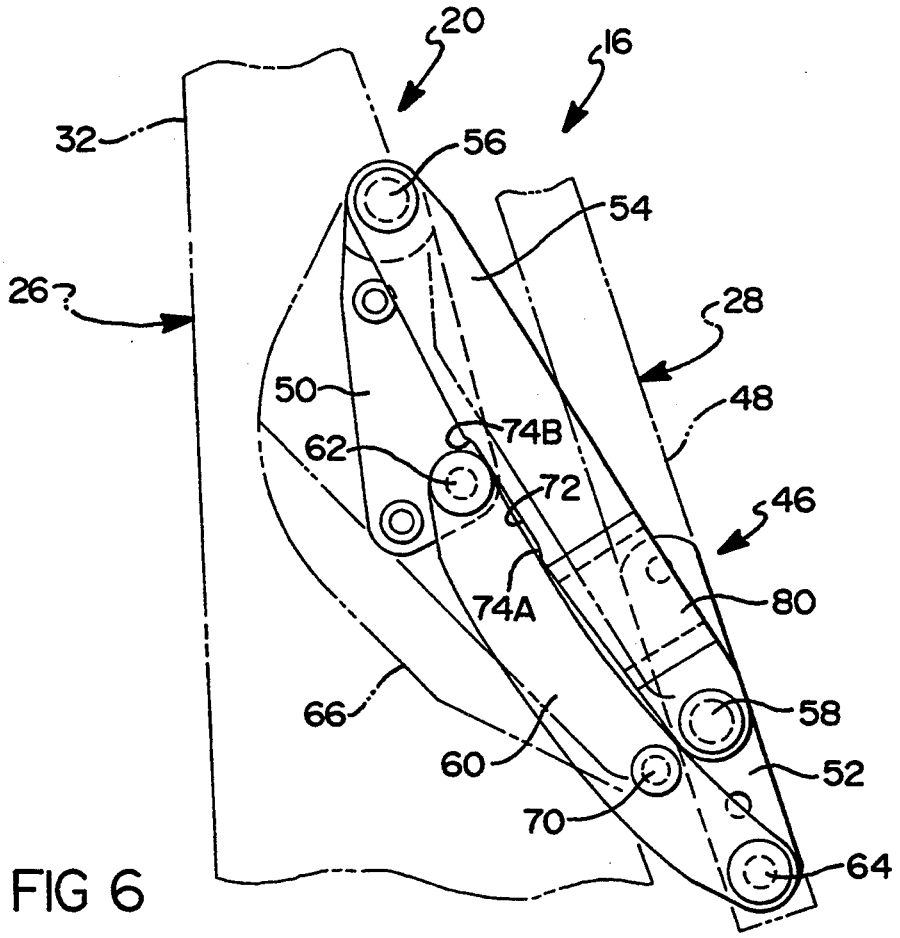
FIG 6

SOFA BRIDGE

BACKGROUND OF THE INVENTION

The present invention relates generally to upholstered articles of furniture and, more particularly, to a detachable seat back assembly of the type used in sofas and modular seating units and having a flip-down table and a storage bin incorporated therein.

Due to the highly competitive nature of the furniture industry, manufacturers have a substantial interest in developing articles of furniture which offer improved comfort and convenience to consumers. Thus, it is known to incorporate various comfort features (i.e., reclining units, rocking units, extensible leg rests, etc.) into the seat sections of otherwise traditional articles of furniture.

To provide additional convenience to the seat occupants, it is known to position a console unit between two seat sections of a sofa or a modular sectional arrangement. One example of such an arrangement is disclosed in U.S. Pat. No. 5,064,244 to Sproule and includes an upholstered console unit having a raised pedestal which functions as a padded arm rest. The raised pedestal, however, tends to detract from the continuity of available seating area on the sofa. Thus, it has been proposed to incorporate a "flip-down" console or table into the center backrest of the sofa. The upholstered backrest can be selectively moved between an upright position wherein the table surface is concealed, and a horizontal position wherein the backrest overlies the seat to permit access to the table surface. Typically, conventional "flip-down" tables utilize a hinge mechanism for causing pivotable movement of the upholstered backrest relative to a stationary portion of the sofa's frame. One example of a "flip-down" table arrangement of the type incorporated into the backrest of a sofa is shown in U.S. Pat. No. 2,240,748 to Bak. A similar construction is shown in U.S. Pat. No. 5,104,182 to Rasnick wherein the hinge mechanism is a snap-type "break-away" linkage that is operable to frictionally retain the movable backrest portion in the open horizontal position under most conditions, yet which becomes releasably disengaged in response to the application of loads on the table which exceed a predetermined value.

SUMMARY OF THE INVENTION

Accordingly, a principle object of the present invention is to provide a modular "bridge" section having a seat frame assembly and a detachable seat back assembly supported therefrom. The seat frame assembly and the detachable seat back assembly are upholstered to define an aesthetically-pleasing seat section which can be installed between two seat sections or, alternatively, which can be used as an armless end unit of a modular sectional arrangement. As a related object, the detachable seat back assembly has a "flip-down" table and a storage bin incorporated therein.

Another object of the present invention is to provide a seat back assembly having a "flip-down" table that is self-supporting for sustaining large loadings without reliance on support from the underlying seat cushion.

Yet another object of the present invention is directed to retrofit installation of the detachable seat back assembly into existing sofas or modular sectional units. Such retro-fit installation can be quickly and simply accomplished without requiring modification or rework to existing framework. In this manner, existing furniture can be easily converted to include a seat back assembly having a "flip-down" table and a storage bin for providing additional comfort and convenience.

The modular "bridge" section of the present invention includes a stationary seat frame assembly and a detachable seat back assembly. The seat back assembly includes an upholstered seat back member that can be detachably secured to the seat frame assembly. In addition, the seat back assembly also includes an upholstered "flip-down" table member which is interconnected for pivotable articulated movement with respect to the upholstered seat back member by a pair of laterally-spaced linkage mechanisms. The linkage mechanisms are self-supporting and synchronously operable to move the table member between a "closed" upright position and an "open" horizontal position with respect to the seat back member. The linkage mechanisms include stop means for positively locating the table member in either of the "open" and "closed" positions. Moreover, due to the articulative movement of the linkage mechanisms, an enlarged opening is maintained within the frame of the seat back member so as to provide an area for convenient installation of the storage bin. A rigid tray is supported from a rear portion of the table member and may include drink wells for retaining bottles and drink glasses, and an enlarged planar work surface. Thus, when the table member is in the "closed" position, a seat back cushion secured to a front portion of the table member acts to conceal the tray and storage bin from view.

Additional objects, advantages and features of the present invention will become apparent to one skilled in the art from the following description and appended claims, taken in conjunction with the accompanying drawings.

BRIEF DESCRIPTION OF THE DRAWINGS

FIG. 1 is a perspective view of an exemplary sofa having a "bridge" section that is equipped with a detachable seat back assembly having a "flip-down" table member shown in a normally upright or "closed" position;

FIG. 2 is a perspective view, similar to FIG. 1, showing the table member of the seat back assembly in a horizontal or "open" position;

FIG. 4 is a top elevational view, taken generally along the circled portion of FIG. 2, illustrating a linkage mechanism used for coupling the table member to a stationary portion of the seat back assembly;

FIG. 6 is a partial enlarged view of FIG. 5 showing the linkage mechanism in a first locked position;

FIG. 8 is a partial enlarged view of FIG. 7 showing the linkage mechanism in a second locked position.

DETAILED DESCRIPTION OF THE PREFERRED EMBODIMENT

With reference to the drawings, an exemplary upholstered sofa 10 is shown to include right and left seat sections 12 and 14, respectively, and a bridge section 16 positioned therebetween. In general, bridge section 16 is a dual-purpose unit having a "flip-down" table incorporated into the seat back that can be selectively concealed or operatively extended. Thus, when the "flip-down" table is concealed, bridge section 16 functions as a conventional seat section to provide a continuous seating area with seat sections 12 and 14. Alternatively, when the "flip-down" table is extended, bridge section 16 functions as a console unit to provide a combination arm rest and table surface.

Preferably, seat sections 12, 14 and bridge section 16 are manufactured as separate upholstered units which can be rigidly assembled into sofa 10 in the manner disclosed in commonly owned U.S. Pat. No. 5,234,253 entitled "Mounting Apparatus For A Modular Sofa Assembly", the disclosure of which is expressly incorporated by reference herein. Alternatively, bridge section 16 is also well-adapted for use with modular sectional units so as to be positionable as either an intermediate unit or as an armless end unit. While not forming part of the present invention, it is contemplated that seat sections 12 and 14 could include such comfort features as reclining seat assemblies and/or extensible leg rest assemblies.

Figure 3:
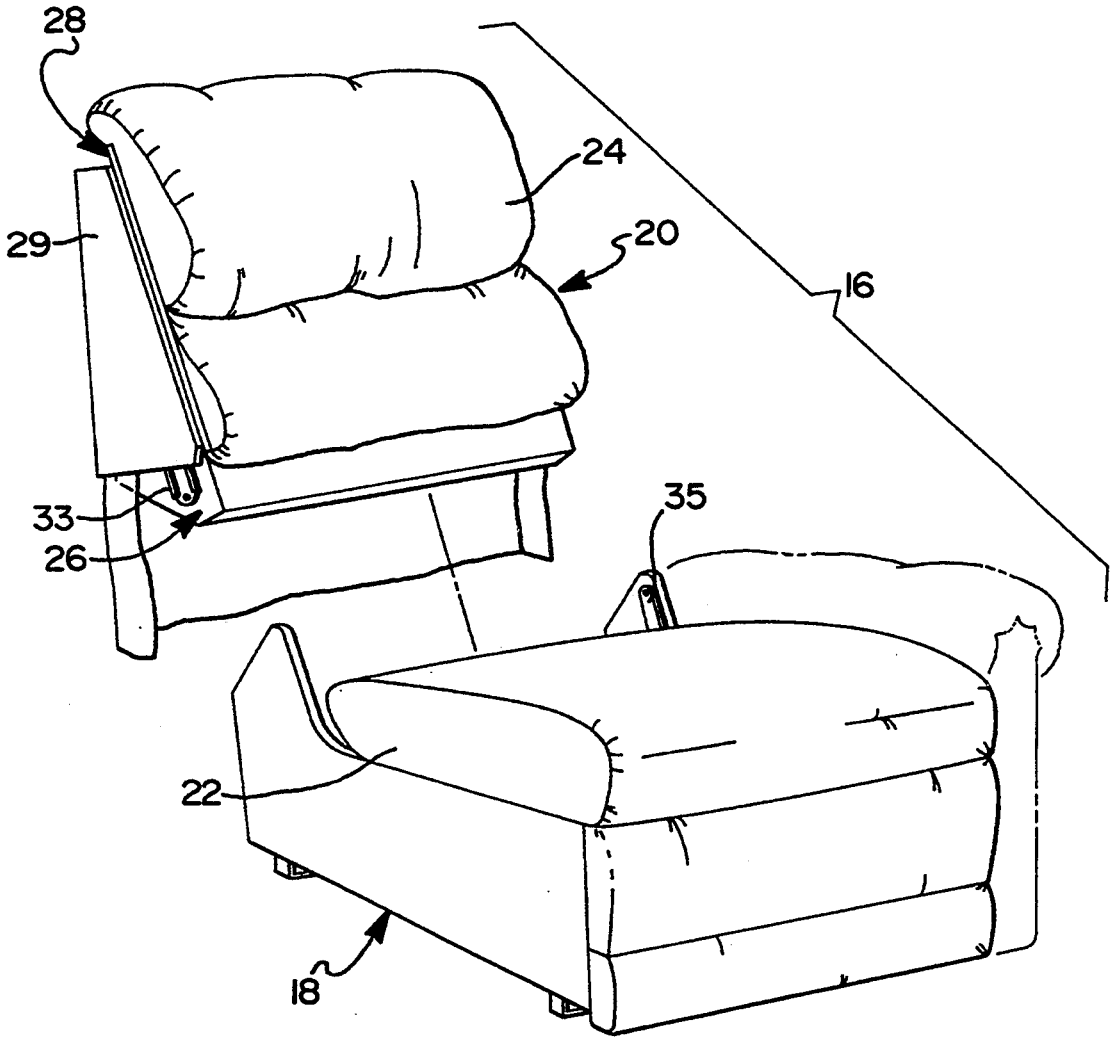
FIG. 3 is a perspective view of the upholstered bridge section showing means for releasably securing the seat back assembly to the seat frame assembly.

As best seen from FIGS. 1 through 3, bridge section 16 is shown to generally include an upholstered seat frame assembly 18 and an upholstered seat back assembly 20. Seat frame assembly 18 is a rigid box-like structure that is adapted to support a seat cushion 22 thereon while seat back assembly 20 carries a cushioned back 24. In accordance with the present invention, seat back assembly 20 includes a stationary back member 26 and a "flip-down" table member 28. To permit bridge section 16 to be used as an end section in a modular sectional arrangement, seat back assembly 20 also includes upholstered side panels 29 that extend forwardly from each lateral side of back member 26 to provide bridge section 16 with a aesthetically-pleasing upholstered appearance. Table member 28 is movable with respect to back member 26 between an upright "closed" position (as shown in FIG. 1) and a horizontal "open" position (as shown in FIG. 2). Cushioned back 24 is carried on a front portion of table member 28 while a multi-purpose tray 30 is secured to a rear portion thereof. In addition, a storage bin 31 is secured within an open area formed in back member 26. Thus, it will be understood that in the upright "closed" position, tray member 30 and storage bin 31 are concealed from view while cushioned back 24 maintains the overall continuity (i.e., "flow lines") of sofa 10. Moreover, it can be seen that in the horizontal "open" position, table member 28 also functions as a inboard armrest for a person seated in either of seat sections 12 and 14.

According to one desirable feature of the present invention, a pair of lockable slide brackets 33 are secured to lateral edge portions of back member 26 and can be inserted over links 35 secured to seat frame assembly 18 for detachably securing seat back assembly 20 to seat frame assembly 18 in a manner similar to that disclosed in commonly owned U.S. Pat. No. 5,184,871 entitled "Detachable Chair Back" the disclosure of which is likewise incorporated by reference herein. Thus, the present invention is superior to conventional console arrangements in that detachable seat back assembly 20 can be retro-fit into existing sofas and sectional units. In this manner, an otherwise conventional backrest can be replaced with detachable seat back assembly 20 to provide the added comfort and convenience offered by "flip-down" table member 28 and storage bin 31.

With reference to FIGS. 4 through 8 wherein bridge section 16 is shown with its upholstery and underlying support structure removed, the functional cooperation of the various components associated with detachable seat back assembly 20 will now be described in greater detail. In general, the inner frame construction for each of back member 26 and table member 28 is conventional in nature and includes wooden beams interconnected using suitable fasteners, adhesives and the like. In particular, back member 26 has a rigid frame structure made of a pair of laterally-spaced vertical side rails 32 that are secured along their lower portions by a pair of transverse cross members 34 and 36. Back member 26 further includes a down-turned U-shaped segment having vertical side beams 38 that are interconnected by an upper cross member 40. To provide rigidity, the inner planar surfaces of vertical side beams 38 overlay the outer planar surfaces of vertical side rails 32 and are secured thereto via suitable means, such as suitable fasteners and/or adhesives, to form a generally box-like back member 26. As best seen from FIGS. 5 and 7, the laterally-spaced vertical side rails 32 are generally triangular and have a forwardly extending lower lug 42 between which cross member 36 is secured. More particularly, a front edge 44 of side rails 32 is tapered to extend forwardly so as to define an enlarged open area within back member 26 between lower cross members 34 and 36. Storage bin 31 is secured within this open area and may include racks, removable trays or other dividers within its interior for organizing items such as books magazines, cassettes, remote controllers and the like To provide means for permitting table member 28 to move between the "closed" and "open" positions with respect to back member 26, a pair of laterally-spaced linkage mechanisms 46 are provided. More specifically, the laterally-spaced linkage mechanisms 46 are operable for coupling an inner box-like frame 48 of table member 28 to vertical side rails 32 of back member 26. While only one linkage mechanism 46 is shown and described in detail, it will be understood that a mirror image linkage mechanism on the opposite lateral side of seat back assembly 20 works in synchronization therewith.

According to the embodiment shown, linkage mechanisms 46 are a two-bar linkage that is adapted to generate articulated pivotable movement of table frame 48. As best seen from FIGS. 6 and 8, each linkage mechanism 46 includes a first pivot bracket 50 mounted to an external planar surface of side rail 32 and a second pivot bracket 52 mounted to an external edge surface of table frame 48. An upper swing link 54 has its first end pivotably connected about pivot point 56 to an upper end of first pivot bracket 50. The opposite end of upper swing link 54 is pivotably coupled about pivot point 58 to a central portion of second pivot bracket 52. In addition, a first end of a lower swing link 60 is pivotably coupled about pivot point 62 to a lower portion of first pivot bracket 50. The second end of lower swing link 60 is pivotably coupled about pivot point 64 to an end portion of second pivot bracket 52 secured in close proximity to a rear edge of table frame 48. Preferably, each of the afore-noted pivot points is defined by a riveted connection between the respective pivot bracket and swing link. Finally, an enlarged shield bracket 66 is coupled for movement between pivot points 56 and 58 so as to inhibit accessibility to pinch points associated with articulated movement of linkage mechanisms 46. Upholstered panels 29 are also helpful in substantially concealing linkage mechanisms 46.

As shown in FIG. 4, shield bracket 66 has a rolled lower edge to prevent damage to upholstery and fabric as the table member 28, and associated linkage mechanisms 46, are moved between the "open" and "closed" positions. Shield bracket 66 is attached to linkage mechanism 46 via rivet means at pivot points 56 and 58 to prevent accidental removal. Further, shield bracket 66 is preferably constructed from steel or other like material. In this manner, shield bracket 66 will not be subject to wear or breakage. In addition, shield bracket 66 increases the general load bearing capacity of table member 28 because it is integral with upper swing link 52, thereby strengthening swing link 52 and the entire linkage mechanism 46.

To provide means for positively locating and supporting table member 28 in the "open" position, a stop rivet 70 is fixed to lower swing link 60 and is engagable with an edge surface of upper swing link 54. More particularly, the lower edge surface of upper swing link 54 has a "carved-out" slot 72 which terminates at each end with generally arcuate surfaces 74A and 74B. Thus, in the horizontal "open" position shown in FIG. 8, the arcuate outer peripheral surface of stop rivet 70 is adapted to matingly engage arcuate surface 74A formed at one end of carved-out slot 72 so as to maintain a continuous "line" of contact therebetween. Such a locking arrangement provides superior stability and rigidity for supporting table member 28 in the "open" position. More specifically, with table member 28 in the "open" position, the widely separated pivot points associated with linkage mechanisms 46 permit table member 28 to withstand static loads that are greater than those anticipated from normal use.

As best seen from FIG. 6, when table member 28 is positioned in its upright "closed" position, linkage mechanism 46 is arranged such that the opposite end 74B of carved-out slot 72 engages the outer peripheral surface of the rivet associated with lower pivot point 62 on first pivot bracket 50. In addition, upper swing link 54 includes a outwardly deformed intermediate portion 80 (see FIG. 4) which is adapted to permit pivot point 64 on lower swing link 60 to move without restriction when table member 28 is pulled out to the "open" position. Thus, the present invention is adapted to provide means for positively locating table member 28 in either of the upright "closed" position or the "open" horizontal position. Due to the compact arrangement and articulated movement of linkage mechanisms 46, the linkage mechanism 46 are completely concealed when table member 28 is in the "closed" position and are substantially concealed when table member 28 is in the "open" position.

Figure 5:
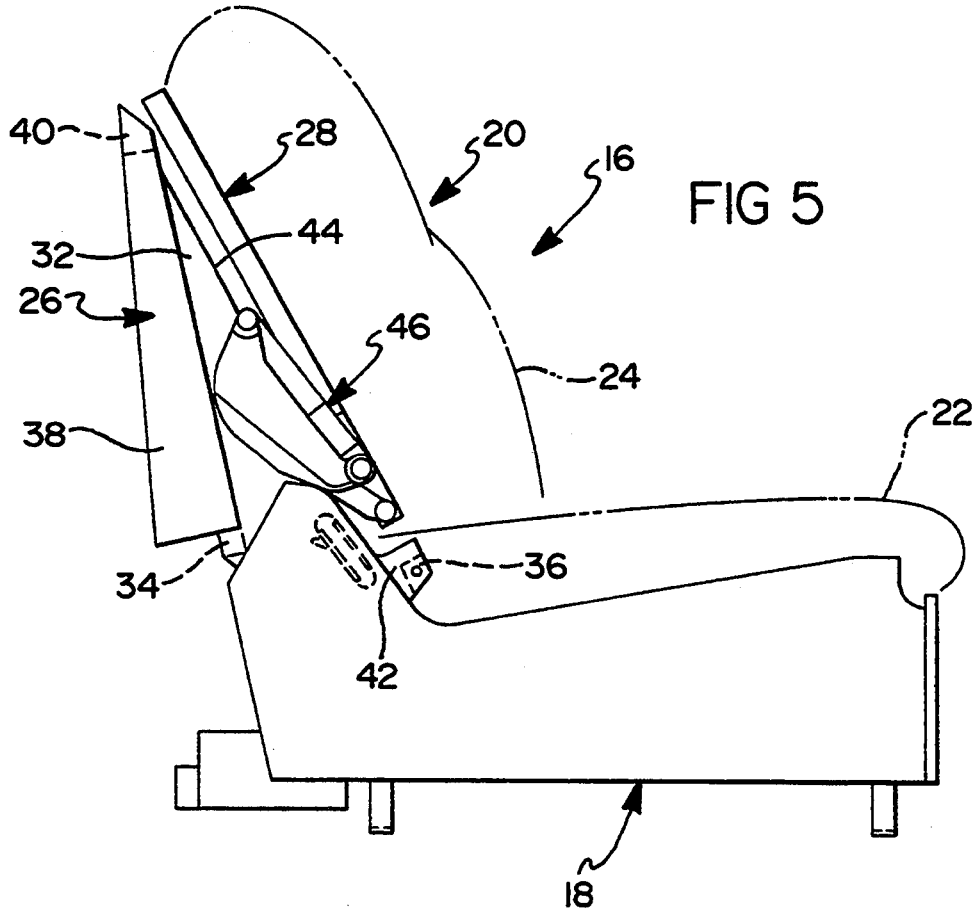
FIG. 5 is a side elevational view of the bridge section, with its upholstery and underlying padding and springs removed for purposes of clarity, showing the seat back assembly in the upright or "closed" position.
Figure 7:
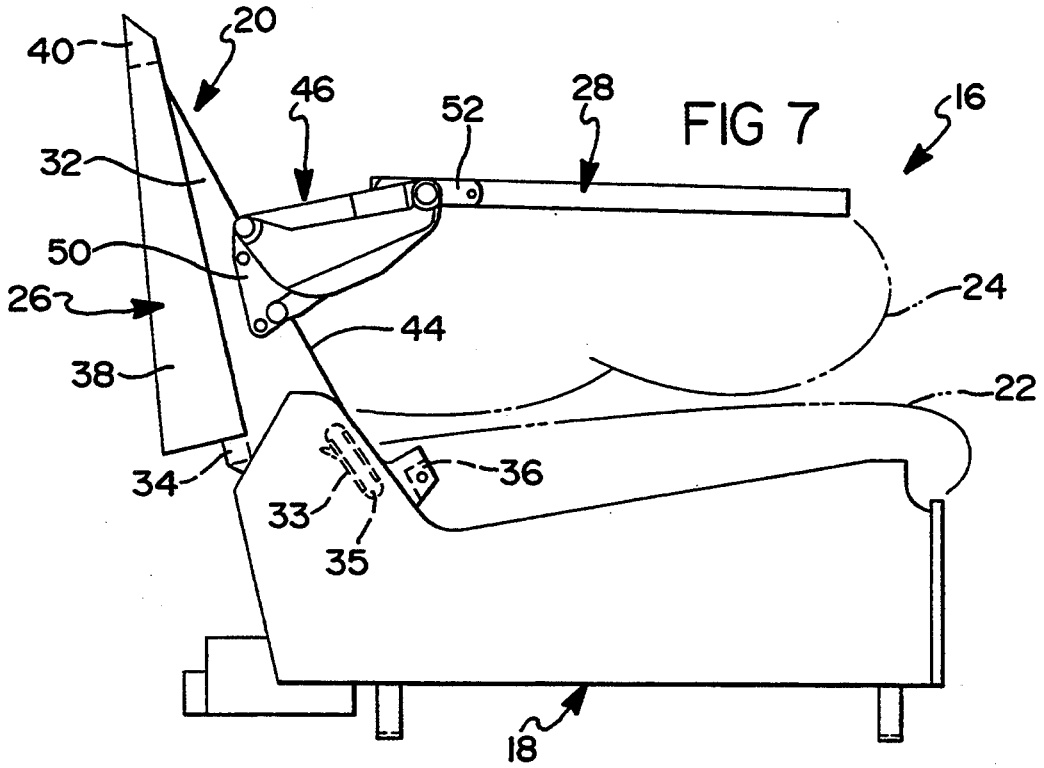
FIG. 7 is a side elevational view, similar to FIG. 5, showing the "flip-down" table member of the seat back assembly located in the "open" position.

When it is desired to move table member 28 from the normally "closed" position of FIGS. 5 and 6, to the "open" position of FIGS. 7 and 8, an upper edge of table member 28 is pulled forwardly and downwardly (i.e., clockwise in the drawings). Such movement causes both swing links 54 and 60 to swing upwardly about their respective pivot points on first pivot bracket 50. As such, the rear portion of table frame 48 is swung forwardly to maintain a clearance relative to storage bin 31 mounted within back member 26. Thereafter, continued movement of table member 28 causes pivot point 64 on the second end of lower swing link 60 to be driven upwardly for rotating second pivot bracket 52 and table frame 48 about pivot point 58 to the desired horizontal orientation. In this position, pivot point 64 is slightly over-center with respect to second pivot point 58 of upper swing link 54, such over-center positioning of pivot point 64 corresponding to engagement of stop rivet 70 with front arcuate end 74A of carved-out slot 72. To return table member 28 to the upright "closed" position, it is simply required to rotate table member 28 upwardly and rearwardly (i.e., counter-clockwise in the drawings). Thus, linkage mechanisms 46 generate an articulated-type of movement which is adapted to maintain the clearance with back member 26. Moreover, linkage mechanisms 46 are "self-supporting" such that table member 28 is held in the "open" position without depending on load-carrying engagement between the underlying seat cushion 22 and cushioned back 24.

The foregoing discussion discloses and describes an exemplary embodiment of the present invention. One skilled in the art will readily recognize from such discussion, and from the accompanying drawings and claims, that various changes, modifications and variations can be made therein without departing from the spirit and scope of the invention as defined in the following claims.

What is claimed is:

1. An upholstered modular bridge section for use with an article of furniture having at least one adjacent seat section, comprising:

a seat frame;

a seat back assembly having a back member and a table member movable between an upright position and an open position, and a storage bin retained within said back member, said table member having a cushion carried on a front surface and a tray secured to a rear surface, said cushion being adapted to conceal said tray and said storage bin when said table member is in said upright position;

linkage means for interconnecting said table member to said back member for movement between said upright and open positions, said linkage means including first and second links pivotably connected at their opposite ends to said back member and said table member;

said second link including an elongated slot along a surface thereof;

a first stop means associated with said first link and engageable with a first portion of said elongated slot of said second link for positioning and supporting said table member in said open position, and positively limiting movement of said table member to a predetermined degree when said table member is moved from said upright position to said open position;

a second stop means associated with said first link and engageable with a second portion of said elongated slot of said second link for positioning said table member in said upright position and positively limiting further movement of said table member past said upright position; and detachable means for releasably securing said seat back assembly to said seat frame.

2. The upholstered modular bridge section of claim 1 wherein said linkage means comprises shield means integrally connected to said first link at its opposite ends for movement with said first link, said shield means being configured to substantially restrict access to any space between said first and second links during movement of said back member between said upright and open positions.

3. The upholstered modular bridge section of claim 1 wherein said first and second portion of said elongated slot are formed at opposite ends of said elongated slot formed in said second link, said first stop means including a first stop rivet fixed to said first link that is engageable with said first portion on said second link when said table member is in said open position.

4. The upholstered modular bridge section of claim 3 wherein said second stop means includes a second stop rivet associated with a pivotable connection between said first link and said back member that is engageable with said second surface on said second link when said table member is in said upright position.

5. The upholstered modular bridge section of claim 4 wherein said first and second portions are first and second arcuate surfaces formed at opposite ends of said elongated slot formed on an edge surface of said second link.

6. The upholstered modular bridge section of claim 5 wherein said linkage means is adapted to cause articulated movement for maintaining said clearance between said table member and said storage bin, and wherein said pivotable connection of said first link with said table member is adapted to be aligned over-center relative to said pivotable connection of said second link with said table member, said over-center alignment corresponding to engagement of said first stop rivet with said first arcuate surface.

7. In a modular sofa arrangement including two seat sections, a modular bridge section positionable between said seat sections comprising:

a seat frame;

a seat back assembly having a back member secured to said seat frame and a table member movable between an upright closed position and a horizontal open position, a storage bin secured within said back member, a cushion supported from a front surface of said table member, and a tray secured to a rear surface of said table member, said cushion adapted to conceal said tray and storage bin when said table member is in said upright closed position; and linkage means for coupling said table member to said back member for movement between said closed and open positions, said linkage means having first and second links pivotably connected at their opposite ends to said back member and said table member and stop means associated with said first link and engageable with first and second surfaces on said second link for positively positioning said table member in one of said upright closed and horizontal open positions, said first and second surfaces being formed at opposite ends of a slot formed in said second link.

8. In the sofa of claim 7 wherein said stop means includes a first stop rivet fixed to said first link that is engageable with said first surface on said second link to positively position said table member in said horizontal open position, and wherein said stop means further includes a second stop rivet associated with said pivotal connection of said first link to said back member that is engageable with said second surface formed on said second link to locate said table member in said upright closed position.

9. In the sofa of claim 8 wherein said first and second surfaces are first and second arcuate stop surfaces formed at opposite ends of said slot formed in an edge surface of said second link.

10. In the sofa of claim 9 wherein said linkage means is adapted to cause articulated movement for maintaining a clearance between said table member and said storage bin, and wherein said pivotable connection of said first link with said table member is adapted to be aligned over-center relative to said pivotable connection of said second link with said table member, said over-center alignment corresponding to engagement of said first stop rivet with said first arcuate stop surface.

11. In the sofa of claim 7 wherein said linkage means comprises shield means integrally connected to said first link at its opposite ends for movement with said first link, said shield means being configured to substantially restrict access to any space between said first and second links during movement of said back member between said upright and open positions.

12. In the sofa of claim 14 wherein said seat back assembly further comprises detachable means for releasably securing said back member to said seat frame.

13. An upholstered modular bridge section for use with an article of furniture having at least one adjacent seat section, comprising:

a seat frame;

a seat back assembly having a back member and a table member movable between an upright position and an open position, and a storage bin retained within said back member, said table member having a cushion carried on a front surface and a tray secured to a rear surface, said cushion being adapted to conceal said tray and said storage bin when said table member is in said upright position; and linkage means for interconnecting said table member to said back member for movement between said upright and open positions, and said linkage means being operable to maintain a clearance between said table member and said storage bin during such movement, said linkage means including first and second links pivotably connected at their opposite ends to said back member and said table member, said second link having a slot formed therein having a first end and a second end, a first stop means associated with said first link and engageable with said first end of said elongated slot for positioning and supporting said table member in said open position, and a second stop means associated with said first link and engageable with said second end of said elongated slot for positioning said table member in said upright position.

14. The upholstered modular bridge section of claim 13 further comprising detachable means for releasably securing said seat back assembly to said seat frame.

15. The upholstered modular bridge section of claim 13 wherein said first and second ends comprise first and second arcuate stop surfaces, respectively, formed at opposite ends of said elongated slot formed in said second link, said first and second stop means respectively comprising first and second stop rivets fixed to said first link and engageable with corresponding ones of said first and second arcuate stop surfaces.

* * * * *